United States Patent [19]

Smithies

[11] Patent Number: 4,686,784

[45] Date of Patent: Aug. 18, 1987

[54] DISPLAY DEVICE

[76] Inventor: Graham Smithies, 17 Stocker Close Basingstoke, Hampshire, RG 21 3 HY, England

[21] Appl. No.: 887,712

[22] Filed: Jul. 21, 1986

[30] Foreign Application Priority Data

Aug. 13, 1985 [GB] United Kingdom ..... 8520247
Mar. 26, 1986 [GB] United Kingdom ..... 8607468

[51] Int. Cl.[4] ..... G09F 19/00

[52] U.S. Cl. ..... 40/406; 40/407; 40/409; 40/410; 350/4.2; 353/2

[58] Field of Search ..... 40/406, 407, 408, 409, 40/410, 486, 152; 350/4.2; 353/2

[56] References Cited

U.S. PATENT DOCUMENTS

| | | | |
|---|---|---|---|
| 1,379,642 | 5/1921 | Meeks | 40/486 |
| 2,435,612 | 2/1948 | Snyder | 40/406 |
| 3,057,094 | 10/1962 | Winkelman | 40/407 |
| 3,101,564 | 8/1963 | Stoessel | 40/407 |
| 3,692,382 | 9/1972 | Cloutier | 40/409 |
| 3,738,036 | 6/1973 | Landsinger et al. | 350/4.2 |
| 3,748,013 | 7/1973 | Orans | 350/4.2 |
| 4,023,289 | 5/1977 | Crawford | 40/406 |
| 4,031,643 | 6/1977 | Templeton | 40/152 |
| 4,034,493 | 7/1977 | Ball | 40/406 |
| 4,085,533 | 4/1978 | Ewald | 40/406 |
| 4,160,427 | 7/1979 | Holbrook | 40/406 |
| 4,208,848 | 6/1980 | Kohl | 40/406 |
| 4,332,096 | 1/1982 | Kohner et al. | 40/409 |
| 4,521,982 | 6/1985 | Altuchow | 40/406 |

FOREIGN PATENT DOCUMENTS

| | | | |
|---|---|---|---|
| 2001315 | 7/1971 | Fed. Rep. of Germany | 40/406 |
| 184739 | 8/1936 | Switzerland | 40/406 |
| 8909 | of 1893 | United Kingdom | 353/2 |
| 1363645 | 8/1974 | United Kingdom | 40/406 |

*Primary Examiner*—Gene Mancene
*Assistant Examiner*—J. Hakomaki
*Attorney, Agent, or Firm*—Neal J. Mosely

[57] ABSTRACT

A display device comprises a sealed flat container formed by two rectangular sheets of glass 10,11 spaced from each other by a small amount and sealed together by a glue layer 12 at their outer edges. The container encloses water and detergent, a quantity of air and fine sand 26. After settling of the sand in one direction, the container is inverted causing bubbles 27 of the air to rise and form a bubble layer partially supporting the sand while allowing it to percolate gradually downwardly between the bubbles.

12 Claims, 2 Drawing Figures

DISPLAY DEVICE

This invention relates to display devices which may have a pictorial form and which may be used as a visual display medium, or as a toy or amusement device, or for advertising or other purposes.

The invention provides a display device comprising a sealed container at least part of the wall of which is transparent, the container enclosing a liquid, a quantity of gas and a particulate material, whereby after settling of the particulate material in the liquid in one direction, the container may be inverted causing bubbles of the gas to rise and form a bubble layer partially supporting the particulate material while allowing it to percolate downwardly between the bubbles.

Preferably, the container is generally flat, being formed by two sheets of material, one or both of which is at least partially transparent, sealed together at their outer edges. These sheets may for example be of glass or clear plastic. The device preferably further comprises a frame supporting the container at its outer edges.

Typically, the liquid contains a bubble producing substance, such as detergent, so as to produce a large number of bubbles when the container is agitated. This enhances the effect of the device. Hydrophilic and hydrophobic agents are normally present in detergents.

The liquid may also optionally include a hydrophilic or hydroscopic substance such as glycerine, forming an emulsion or colloidal suspension.

The particulate material preferably comprises material of two different colours and optionally of more than two different colours. A fine particulate material is envisaged as appropriate and thus sand is a preferred material. Hence two different coloured grains of sand may be used, normally a light sand and a dark sand for appropriate contract. A more finely divided or powdery particulate material might be used such as calcium carbonate. The materials of different colours may preferably be of different densities so that they descend through the liquid at different rates, thus resisting the tendency for the different colours of materials to become evenly mixed.

The liquid may contain a colouring pigment.

An embodiment of the invention will now be described, by way of example, with reference to the accompanying drawings, in which.

Figure 1:
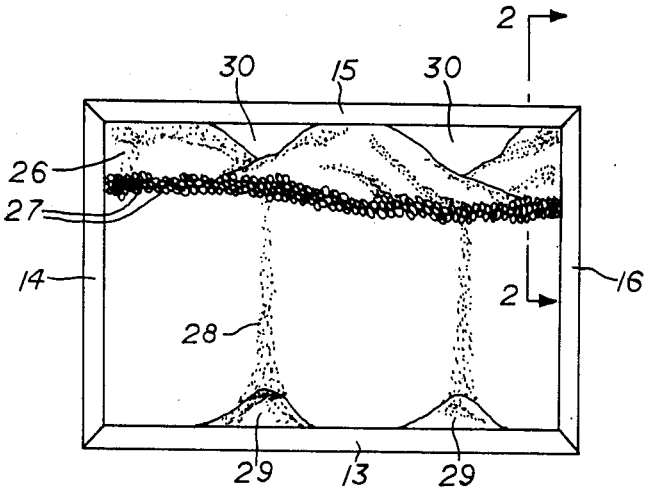
FIG. 1 is a side elevation of a display device embodying the invention.
Figure 2:
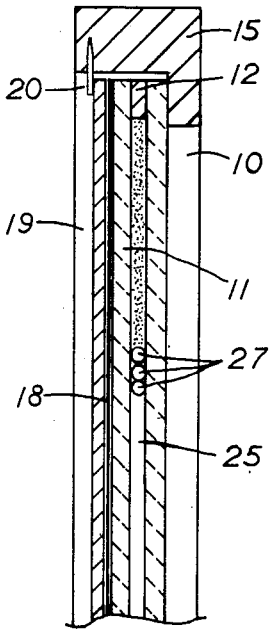
FIG. 2 is a sectional view of an enlarged scale taken on the plane indicated II—II in FIG. 1.

The display device illustrated comprises a sealed container formed by two rectangular sheets of clear glass 10 and 11 sealed together around their outer edges by a layer of adhesive 12. The flat sealed container thus produced is mounted in the rebate of a frame comprising horizontal members 13, 15 and vertical members 14, 16. A background sheet of paper carrying an appropriate coloured design, for example a spectrum created by an air brush, is laid against the back of the sheet of glass 11. Agains this background sheet is laid a backing layer 18 of, for example, cardboard. The loose assembly of container, background sheet 18 and backing layer 19 are retained within the rebate of the frame by some suitable means such as staples 20 impaled into the frame.

Optionally, an additional sealant, such as a silicone sealant, may be applied to the outer periphery of the adhesive layer 12 and the peripheral edges of the glass sheets 10 and 11.

The container formed by the glass sheets 10, 11 and adhesive layer 12 contains tap water 25 in which a small amount of detergent and of ammonia has been mixed, a small quantity of air and a quantity of sand 26.

The sand 26 is allowed to settle in one direction, with frame member 15 lowermost and member 13 uppermost. The device is agitated to cause the air to break up into a multiplicity of bubbles 27. The device is then inverted, preferably by rotation about an axis parallel to and midway between member 13 and 15, through 180° so as to bring member 15 uppermost and member 13 lowermost as shown in FIG. 1. The bubbles 27 rise in the liquid and form a layer beneath the bulk of the sand (it will be appreciated that a small amount of sand will escape and fall immediately towards the member 13 before the bubble layer can form properly). Where the bubble layer is thin or not tightly packed, the sand is allowed to percolate gradually between the bubbles down through the bubble layer and falls downwardly as shown by reference numeral 28.

Sometimes the bubble layer becomes so even and/or closely packed that it prevents all penetration by the sand. If this happens, a slight agitation of the device is usually sufficient to restart percolation. As the air bubbles rupture due to collision with adjacent bubbles, or due to the weight or abrasive nature of the suspended particules, or the re-alignment or re-combination of bubbles, minute breaks occur at random and in a sporadic manner in the air bubble layer allowing further particles to percolate through the bubble layer. Because of the viscosity of the liquid and turbulence caused by the particle movement, the individual particles do not follow an exactly vertical path to the bottom of the container but instead tend to move in a slightly random irregular manner, particularly when a larger stream develops. As the weight of the particulate material on the bubbles decreases and disappears, the bubbles rise to the top of the container. Eventually, all the particles suspended above the layer of bubbles will pierce the bubble layer and fall to the bottom of the container but because of the irregular path followed by the particles through the liquid and the unpredictable distribution and behaviour of the bubbles, the particles will be deposited in an unpredictable way in random heaps or layers at the bottom of the container.

When all the particles have finally settled on the bottom of the container, the device may be again inverted, preferably as before by rotation through 180° about the above mentioned axis, and the process will recommence with the bubbles rising and the suspended particles located above the bubble layer allowing the particles gradually to pass through in the random, sporadic manner described hereinbefore. The effect is of a picture with the particles falling from the upper part to the bottom of the frame and being deposited in a random manner to simulate a landscape effect of "hills" or "mountains" 29, plains, valleys etc. During the course of percolation, there is a tendency for the pattern of accumulated sand at the bottom to be mirrored in corresponding voids 30 at the top in which there is liquid alone.

It will be appreciated that the invention has many uses, apart from the visual appeal as a moving picture. The ever changing pattern has a therapeutic effect on the viewer, making it particularly appropriate for mentally handicapped persons and convalescents. The device may be used for advertising purposes or as a special effects background feature for films.

In order to prevent or inhibit the development of fungii, algae or bacteria, the water referred to above may be distilled water instead of tap water or may alternatively be treated with a fungicide and/or a bactericide. A suitable fungicide is Adesol 20, used in the ratio 1 to 1000 parts water.

The detergent may be used in the ratio 1 to 250 parts of water.

The ammonia is employed as a dispersing agent (other such agents may be used) to improve dispersion of the pigment and sand in the liquid. An appropriate ratio of ammonia to water is 1 part to 100.

I claim:

1. A display device comprising a flat sealed container comprising two substantially flat sheets of material supported in closely spaced relation and sealed together at their outer edges to provide a thin chamber, one of said substantially flat sheets of material being substantially transparent, permitting viewing of said chamber therethrough, a quantity of liquid substantially filling said chamber, a small quantity of gas in said chamber sufficient to form bubbles therein upon agitation or inversion of said container, said chamber having a thickness substantially the size of bubbles formed therein upon agitation or inversion of said container, and a particulate material in said chamber in a quantity sufficient to fill a substantial fraction of the height of said chamber when said container is positioned vertically and freely movable to form decorative patterns as viewed through said substantially transparent flat sheet of material, whereby after settling of the particulate material in the liquid in one direction upon positioning said container vertically, said container may be inverted vertically to cause bubbles of the gas to rise and form a bubble layer partially supporting the particulate material while allowing it to percolate downwardly between the bubbles to form a new and different decorative pattern.

2. A display device according to claim 1 in which the other flat sheet of material has a decorative image supported thereon as background for the decorative pattern formed by said particulate material in said chamber.

3. A display device according to claim 1 including a frame supporting the container at its outer edges.

4. A display device according to claim 1 in which the liquid contains a bubble producing substance.

5. A display device according to claim 1 in which the particulate material comprises a particulate mineral material.

6. A display device according to claim 5 in which the particulate mineral material is sand.

7. A display device according to claim 1 in which the particulate material comprises at least two materials of two different densities.

8. A display device according to claim 1 in which the particulate material comprises at least two materials of different colors.

9. A display device according to claim 1 in which the liquid is water.

10. A display device according to claim 8 in which the water contains a fungicide or bactericide.

11. A display device according to claim 1 including a dispersing agent for the particulate material.

12. A display device according to claim 10 in which the dispersing agent for the particulate material is ammonia.

* * * * *